US005984796A

United States Patent [19]

Mah

[11] Patent Number: 5,984,796

[45] Date of Patent: Nov. 16, 1999

[54] GOLF SWING TRAINING DEVICE FOR DETECTING CORRECT WEIGHT SHIFT

[75] Inventor: Myong Chun Mah, 2161 N.School St., #506, Honolulu, Hi. 96819

[73] Assignee: Myong Chun Mah

[21] Appl. No.: 09/153,731

[22] Filed: Sep. 15, 1998

[51] Int. Cl.[6] ..... A63B 69/36

[52] U.S. Cl. ..... 473/215; 473/409

[58] Field of Search ..... 473/209, 211, 473/212, 213, 215, 409

[56] References Cited

U.S. PATENT DOCUMENTS

| | | | |
|---|---|---|---|
| 2,191,683 | 2/1940 | Roberts | 473/213 X |
| 3,156,211 | 11/1964 | Mallory | 473/211 |
| 3,368,817 | 2/1968 | Duncan | 473/215 |
| 3,528,664 | 9/1970 | Gunn | 473/213 |
| 3,808,707 | 5/1974 | Fink . | |
| 3,860,245 | 1/1975 | Yamada | 473/213 |
| 5,005,835 | 4/1991 | Huffman | 473/209 |
| 5,040,790 | 8/1991 | Anthes et al. . | |
| 5,050,885 | 9/1991 | Ballard et al. . | |
| 5,082,281 | 1/1992 | Berghofer . | |
| 5,221,088 | 6/1993 | McTeigue et al. . | |
| 5,372,365 | 12/1994 | McTeigue et al. . | |

*Primary Examiner*—George J. Marlo
*Attorney, Agent, or Firm*—Leighton K. Chong

[57] ABSTRACT

A golf swing training device has a compact device housing to be worn at the waist of a user on one hip which contains an inertial mass acceleration sensor for detecting when the user has moved the hip in a weight shift exceeding a given threshold level and for producing a sound output indicative of a correct weight shift for a golf swing. In one embodiment, the housing is a cylindrical tube, the sensor is a weighted metal ball held by a given retaining force of a magnet at one end of the tube, and the sound is produced by the ball striking a stop wall at the opposite end. When the user completes a hip turn and decelerates to a finish, the weighted ball travels back to the retaining end of the tube and produces a second sound which indicates correct completion of the golf swing. The device housing may have a fastener strip to allow it to be worn at an angle to vary the threshold weight shift force required. A second embodiment uses a spring-mounted plastic cup with a friction-fit hemispherical shape for retaining the ball therein. A third embodiment employs an electronic motion sensor as the mass acceleration sensor, and includes an electronic circuit, tone generator and output speaker, volume control, and LCD display.

20 Claims, 4 Drawing Sheets

GOLF SWING TRAINING DEVICE FOR DETECTING CORRECT WEIGHT SHIFT

TECHNICAL FIELD

This invention generally relates to a golf swing training device, and more particularly, to one which detects when a person's body motion is applying a correct swing force.

BACKGROUND OF THE INVENTION

Of the three pillars of a good golf swing, i.e., the grip, the stance, and the swing motion, the hardest to teach and maintain is a correct swing motion. Teaching professionals have many tips for monitoring the execution of a correct swing motion, such as taking the club back low and slow, extending the arms back swinging the club back over the head, keeping the wrists and arms cocked, rotation of the shoulder and the back turn aligned with the swing plane, initiating the down swing with the body not the arms, keeping the eyes on the ball and the head still, turning the hips, shifting one's weight forward toward the target, keeping a full arm extension at impact, turning the arms over to keep the clubface closed, executing a smooth follow through, keeping a proper balance and alignment at the finish of the swing, etc. While all of these are good pointers to improve a golf swing, it is difficult for the person to keep all of these swing components in mind and execute the swing correctly.

Furthermore, not all of the elements of a swing must be monitored at all times to train a person to improve their swing. Some elements, such as grip, stance, club take back, alignment, and follow through, can be taught in a limited number of sessions and need not be monitored every time a person takes a practice swing. On the other hand, some elements, such as swing tempo, hip turn, and weight shift, are so subtle or happen so quickly that they should be monitored during a person's practice swing to detect whether they were executed properly.

Many training devices and techniques have been proposed for aiding a person to execute a good swing motion. For example, U.S. Pat. Nos. 5,221,088 and 5,372,365 to McTeigue disclose measuring a person's weight shift with foot sensors, grip pressure with club handle sensors, and/or shoulder rotation with back-worn sensors to produce audible tones indicating when these factors of the swing motion are within acceptable ranges. U.S. Pat. No. 5,050,885 discloses a mechanical armature device that is attached to a person's thighs, waist, and back to maintain the desired posture, alignment, and motion of body parts during a swing. U.S. Pat. No. 3,808,707 to Fink, U.S. Pat. No. 5,040,790 to Anthes, and U.S. Pat. No. 5,082,281 to Berghofer disclose playing various types of audible cues indicative of the proper tempo and speed of the ideal swing against which the person can compare the execution of their actual swing.

However, the previous proposals have had disadvantages in that those that are attached to a person's body parts to measure or guide their motion are awkward to wear and encumber the person's swing, while those that only issue tones for the timing or tempo of a correct swing do not measure the person's actual execution of the swing. The prior devices have also provided an audible prompt for the motion of only one body part, or multiple prompts for several body parts that may be confusing for the person to listen to.

There have also been many proposals for training devices that measure the speed, angle, height, force, and/or alignment of the club during a swing. However, these devices do not provide an actual indication whether the motion of the person's body in executing the swing was correct.

SUMMARY OF THE INVENTION

It is therefore a principal object of the present invention to provide a golf swing training device that can be worn by the person to provide an audible prompt indicative of a correct swing, and yet does not encumber the person's swing. It is a further object of the invention to provide a training device that is simple and convenient to wear on the body yet provides an audible indication whether the more important elements of a person's swing movement were correct, so that the person can listen for a single audible cue for a correct swing without confusion.

In accordance with the invention, a golf swing training device comprises a compact device housing having attachment means for attaching it to be worn on the waist of a user adjacent one hip on a side of the user in a forward direction of the user's golf swing, an inertial mass acceleration sensor contained in said device housing for detecting when the user has moved the one hip with an acceleration exceeding a given threshold level upon execution of a golf swing, and a sound producing device coupled to said sensor for producing a sound output when the acceleration of the user's hip upon execution of the golf swing exceeds the given threshold level.

In a first preferred embodiment, the housing is a cylindrical tube, the inertial mass acceleration sensor is comprised by a weighted metal ball held with a given level of retaining force by retaining magnet at one end of the tube in the forward direction of the user's golf swing, and the sound producing element is a stop wall at an opposite end of the tube. When the user accomplishes a weight shift above the threshold level, the weighted ball disengaged from the retaining magnet and strikes the stop wall to produce a sound indicative of a correct weight shift. As the user completes a hip turn with the golf swing and decelerates to a finish, the weighted ball travels back to the retaining end of the tube and produces a second sound which indicates to the user correct completion of the golf swing. Other variations include a device housing which can be worn at an angle to vary the threshold weight shift force required, multiple weighted balls, and battery-powered magnet and sound element.

In a second preferred embodiment of the invention, the inertial mass acceleration sensor is comprised of a weighted ball at one end of a plastic tube held in a plastic friction-fit cup, and a plastic stop wall 34 is the sound producing element. The cup has a hemi-spherical shape with an internal diameter slightly smaller than the weighted ball so that the ball is held firmly in the cup when pressed therein.

In a third embodiment of the invention, the inertial mass acceleration sensor is an electronic component, such as a mercury switch or other type of motion detector, which is connected to a circuit which sounds a tone through an output speaker when the sensor detects a weight-shift force exceeding the threshold. The motion sensor may also detect the speed and timing of completion of the user's hip turn, and produce a second sound and/or display a measured result on an LCD display.

Other objects, features, and advantages of the present invention will be explained in the following detailed description of the invention having reference to the appended drawings.

DETAILED DESCRIPTION OF INVENTION

The present invention proceeds from the observation that many more persons learn to execute a decent baseball swing and make contact with a baseball or a softball, than learn to execute a decent golf swing. The same basic mechanics of eye-hand coordination and taking a swing at a ball by turning the wrist, arms, shoulders, and waist in an athletic motion are present in golf as in baseball. However, the difference is that in golf the person is hitting a ball that is still, whereas in baseball the person hits a ball in motion. Golf requires a substantial weight shift forward at the same time as the turning of the hips in order to apply sufficient momentum and force against the motionless ball to drive it a reasonable distance toward the target. A person cannot execute a good golf swing simply by swinging their arms and turning with their weight over their feet (as in baseball). Instead, the person must execute a distinct shift of their weight from predominantly over the right foot (for right-handed golfers) to predominantly over their left foot, and from the ball of their left foot to firmly on the left heel to turn forward through impact. In a natural golf swing, the person must initiate their downward swing and turn toward impact with a weight shift of the body first, and not with the arms and shoulders first. The present invention is designed as a simple way to indicate to the person when their weight shift forward and hip turn through impact have been executed correctly.

Figure 1B:
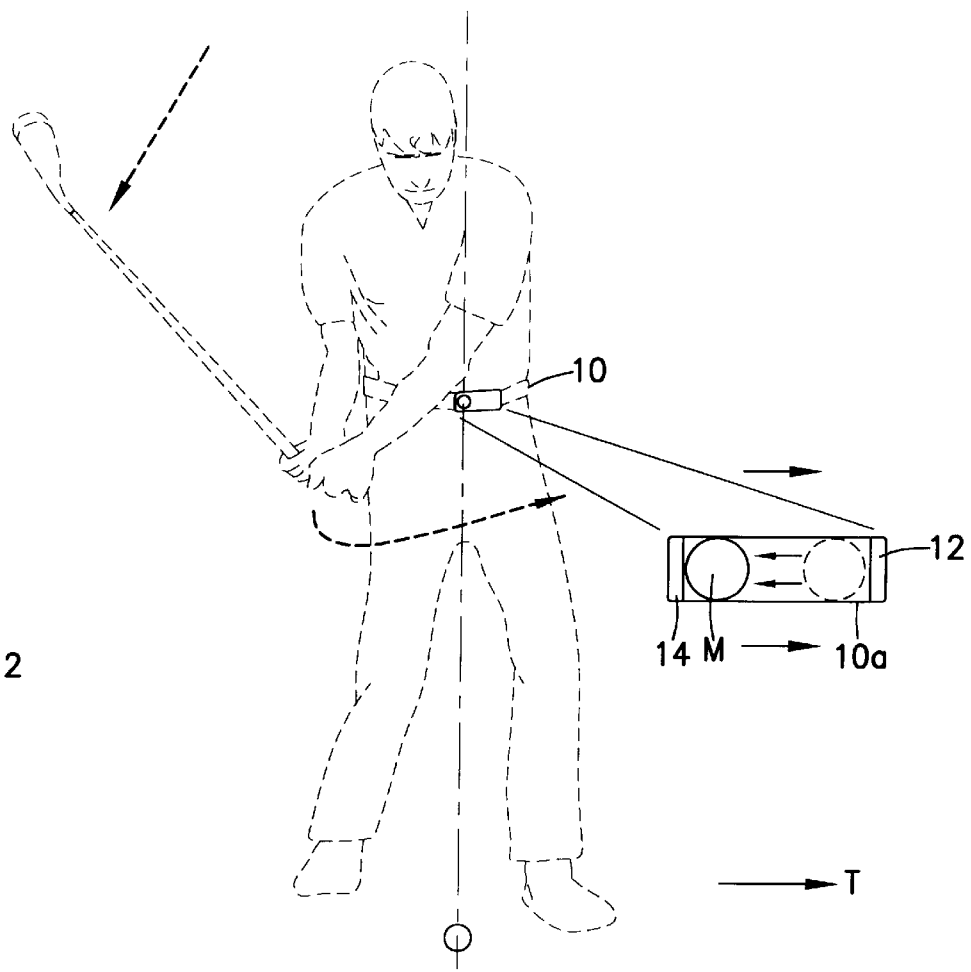
FIGS. 1A and 1B depict a golfer using the golf swing training device of the present invention, and the operation of the device during taking back of the club and starting a down swing with a weight shift.
Figure 1A:
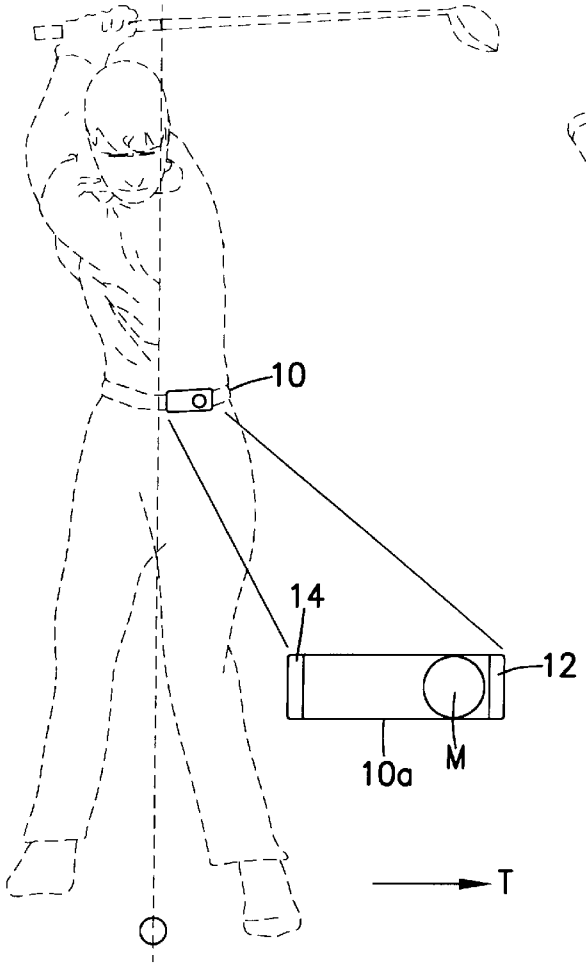

Referring to FIGS. 1A and 1B, the basic principle of the invention is illustrated through the use of a compact device 10 having an inertial mass acceleration sensor contained in a device housing worn on the person's hip in a forward direction of the golf swing. The sensor detects when the person has initiated a substantial weight shift of the body forward toward the target T (in the case of a right-handed golfer, the device is worn toward the left hip). The device may have loops or clips to be worn on the person's belt, or it may be pinned to the waist of the person's pants or shorts, or held by a strap or belt accessory.

In a first preferred embodiment, the inertial mass acceleration sensor is comprised of a transparent plastic tube 10*a* with an inertial mass M contained therein. A retaining element 12 is arranged at one end to hold the mass M in place with a slight retaining force until a sufficient weight-shift force has been applied to the tube 10*a* to disengage the mass M away from the retaining element 12. A sound-producing element 14 is arranged at the opposite end of the tube 10*a* to issue an audible sound when the disengaged mass M has traversed the length of the tube 10*a* to impact against the element 14.

To use the device 10, a right-handed golfer addresses the ball wearing the device 10 on his/her left hip with the mass M held at the end against the retaining element 12. A left-handed golfer can use the same device worn inverted. As the (right-handed) golfer takes the club back toward his/her right side, in FIG. 1A, the retaining force of the element 12 is sufficient to hold the mass M against the slight forces of motion. In FIG. 1B, the golfer begins the downward swing of the club toward impact with the ball. In a correct swing, the downward movement should be initiated by a weight shift of the golfer's body to his/her left side toward the target T. If the weight shift is substantial, the acceleration force F on the tube 10*a* at the golfer's left hip is strong enough to disengage the mass M, which travels the length of the tube and strikes the sound producing element 14. This gives the golfer an audible indication of a swing motion initiated by a correct weight shift. If the weight shift is weak, the acceleration force F on the tube 10*a* will not be strong enough to disengage the mass M, and no sound will be produced.

After the mass M has struck the element 14, and as the golfer powers through the ball with a sharp turn of the hip to his/her left, the deceleration force on the tube at the end of the golfer's hip turn will be sharp enough to cause the mass M to strike the retaining element 12 with a speed matching the deceleration force. Therefore, a correct hip turn that should complete the swing motion will produce a second sound as the mass M strikes the retaining element 12. The time interval of the second sound after the first also indicates the speed of the golfer's turn, and how quickly the turn was completed from the time the swing started (initiation of weight shift). If the golfer arrests or decelerates his/her swing motion or does not finish the hip turn, only a small sound or no sound may be produced by the mass M.

Thus, the device 10 will produce a distinctive "click-click" sound when a swing is properly executed, or a "click . . . " or no sound at all (the mass M remains attached to the retaining element) if the swing is not properly executed. The device is small and can be worn conveniently without encumbering the golfer's swing, yet it provides direct audible feedback to the golfer as to how the swing has actually been executed. The audible feedback is only one cue that the golfer listens for, yet it can indicate many elements of the swing to the golfer, including the force of the weight shift, the sharpness of the hip turn, and the time interval to the completion of the hip turn. The golfer can monitor the characteristics of his/her best swing by the particular sound produced. For example, a short, powerful golfer may produce a "CLICK.CLICK" sound, whereas a smooth, lanky golfer might produce a "click . . . click" sound. The golfer thus has a convenient way to assess whether another swing replicates the characteristics of the best swing.

Figure 2A:
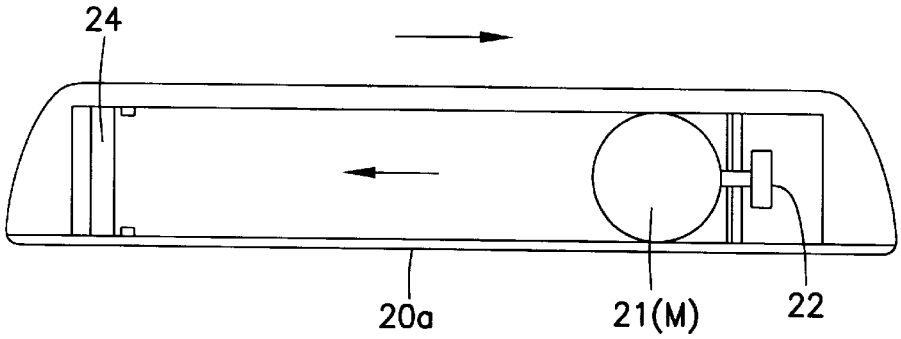
FIGS. 2A and 2B are side and perspective views showing a first preferred embodiment of the invention in the form of a magnetically-restrained metal ball in a tube.
Figure 2B:
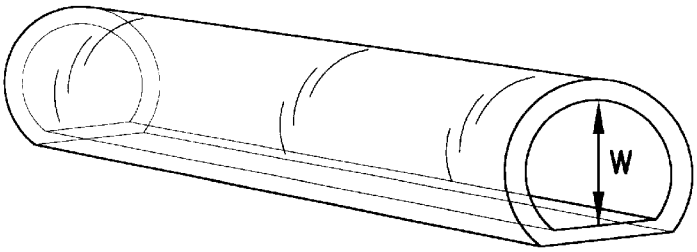
Figure 2C:
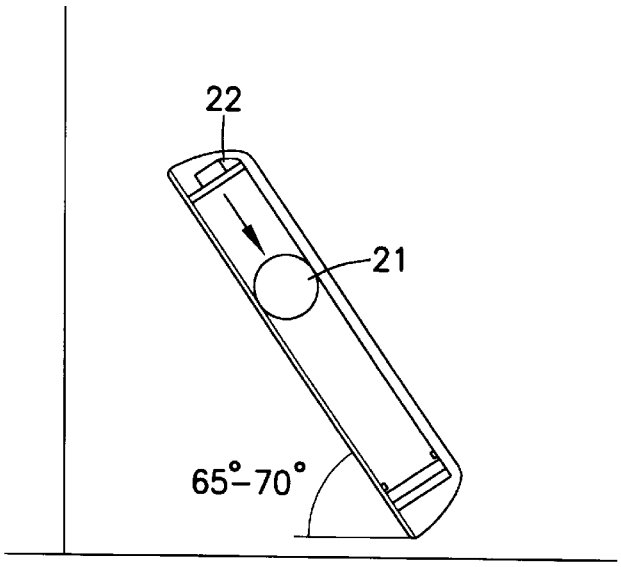
FIG. 2C illustrates the selected restraining force of the magnet.

Referring to FIGS. 2A, 2B, and 2C, one example of the first preferred embodiment is shown having a weighted ball 21 as the mass M contained in a cylindrical plastic tube 20*a,* a magnet 22 as the retaining element, and a plastic stop wall 24 as the sound producing element. The weighted ball 21 can be a steel ball bearing of about 16 mm diameter with a weight of about 25 gms (1 oz). This is a common machine part that has the characteristics needed. The tube has a diameter slightly larger than the diameter of the steel ball, i.e., about 17 to 18 mm, so that the movement of the ball in the tube can be guided smoothly without vibrations or perturbations.

The magnet 22 is selected to have a force sufficient to retain the steel ball against normal jostling from walking or bending over, but is overcome when a weight-shift force of a substantial amount is applied. It is found that the proper magnetic force is about the force that would retain the steel ball 21 against the force of gravity as the tube is inclined to an angle of about 65 to 70 degrees, as illustrated in FIG. 2C.

Figure 2D:
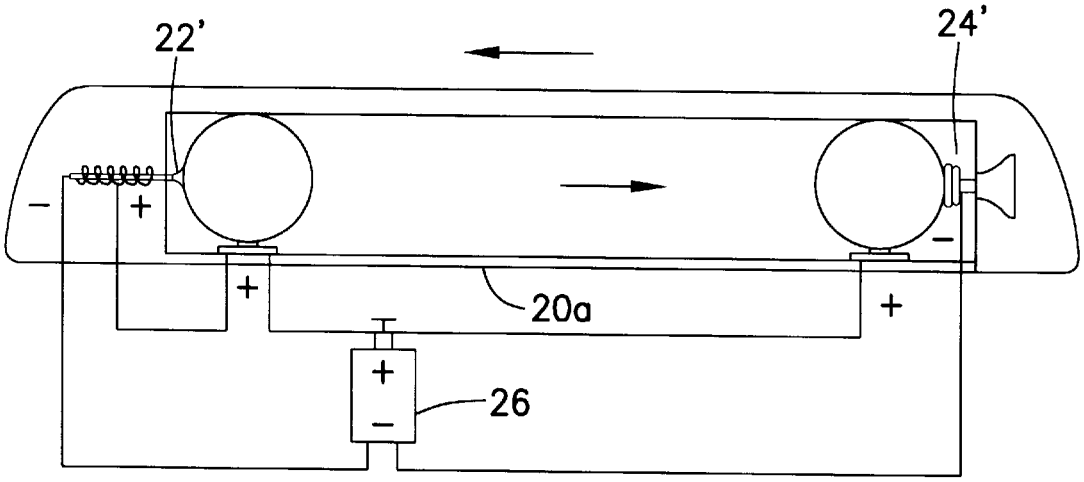
FIG. 2D illustrates a battery-powered version.

As shown in FIG. 2D, another version of the preferred embodiment has a battery power source 26 which is connected to an electrically actuated magnet 22' for the retaining element, and an electrically actuated sound element 24'. In this version, the magnet is powered by the battery 26, and the ball strikes a switch element that closes a circuit and sounds the sound element 24'. Another variation has a number of steel balls (two or three) so that different levels of weight-shift forces will cause different numbers of balls to be released from the magnet and make different sounds on impact.

Figure 2E:
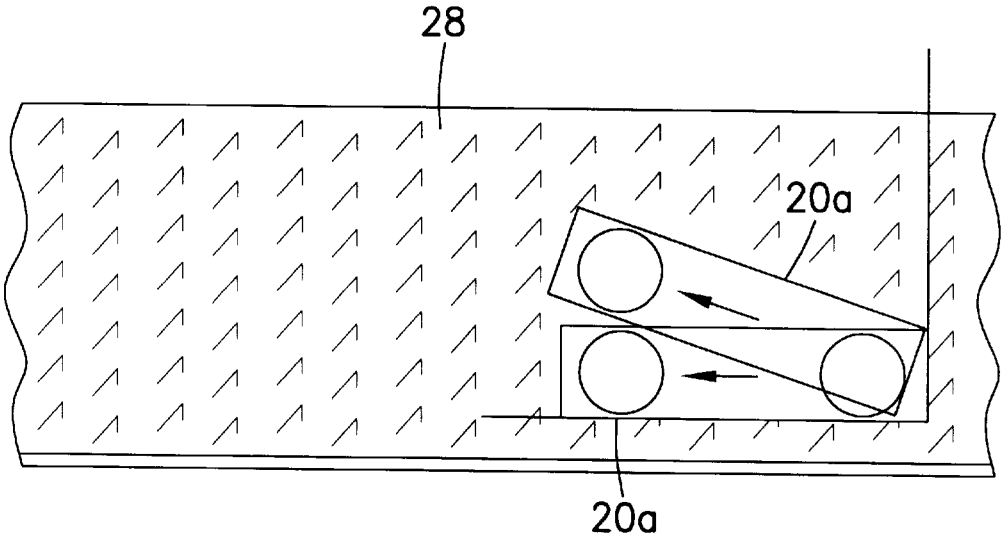
FIG. 2E illustrates a hook-and-loop version wherein the weight-shift level of the device can be adjusted.

A further variation of the device, shown in FIG. 2E, has a hook-fastener strip on the back of the tube 20*a* which fastens to a loop landing zone on a belt or strap 28 to be worn by the golfer. The wearer can attach the hook fastener strip of the tube 20*a* to the loop fastener zone of the belt 28 in the horizontal position or at an inclined angle. The horizontal position is the position in which the smallest retaining force is applied to the mass M. The steeper the inclined angle, the greater the retaining force applied, (due to the combination of magnetic force and gravity).

Figure 3:
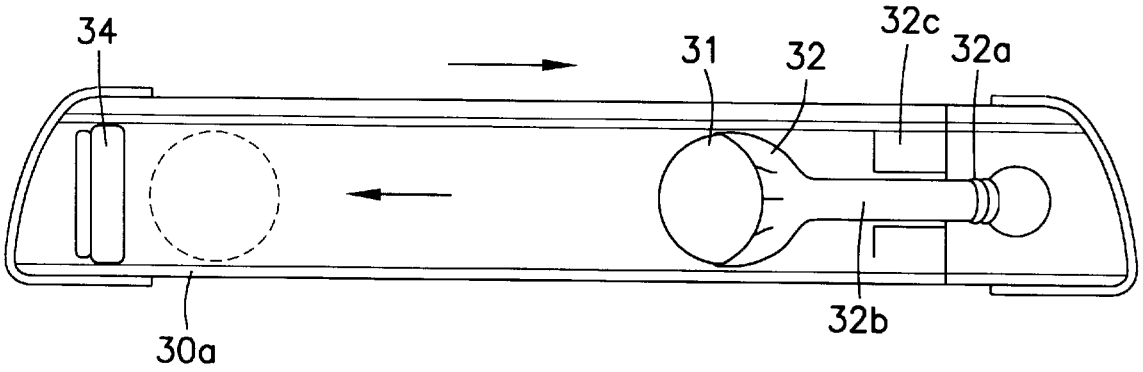
FIG. 3 is a side view showing a second preferred embodiment of the invention in the form of friction-fit restrained ball in a tube.

In FIG. 3, a second preferred embodiment of the device is shown having a weighted ball 31 as the mass M contained in a transparent plastic tube 30*a*, a plastic friction-fit cup 32 as the retaining element, and a plastic stop wall 34 as the sound producing element. The cup 32 has a hemi-spherical shape with an internal diameter slightly smaller than the weighted ball 31, such that the ball is held firmly in the cup 32 when pressed therein. The cup may be provided with slits to give its retaining surface flexibility to deform outwardly when the ball is pressed into the cup. The retaining force is sufficient to hold the ball until the desired threshold for the weight-shift force is exceeded. The cup may be spring-loaded by a spring 32*a* applied over a stem 32*b* for elastically mounting it through the mounting wall 32*c*. The spring 32*a* helps to dissipate the return force pressing the ball back into the cup, so that the plastic cup surfaces are not damaged. The return force of the golfer's deceleration on completion of the hip turn is sufficient to press the ball back into the cup on the return motion. However, it may also be pressed in by shaking the ball downward by gravity against the cup. This version can be manufactured simply and inexpensively by plastic molding of parts and assembly with endcaps.

Figure 4:
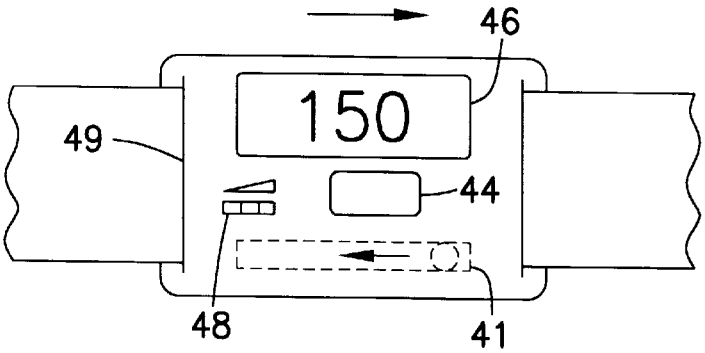
FIG. 4 is an illustration showing a third preferred embodiment of the invention in the form of a wearable electronic device using a motion detector sensor.

In FIG. 4, a third preferred embodiment of the device is shown having a motion sensor 41 carried therein which is electronically connected to a circuit which activates a tone generator to sound a tone through the output speaker 44 when the sensor 41 detects a weight-shift force exceeding the threshold. The sensor 41 can be a mercury switch or a capillary tube element which are commonly used in the electronics industry as motion detectors.

Such motion detectors can have a specified motion detection threshold equal to the weight-shift threshold desired. Some motion detectors can also detect the speed and time interval of motion (for example, by the detecting the traverse of a mercury drop past an array of electronic contacts). Thus, the device can detect the speed and timing of the user's hip turn as well, and can produce a second sound and/or a display of a measured result on an LCD display 46 to display weight-shift force or hip turn speed measurement. A sound volume switch 48 may also be provided. The device circuitry can include a restore circuit to apply an electromagnetic force to return the sensor element to its initial position. The device is shown having loops 49 for wearing on a belt.

It is to be understood that many modifications and variations may be devised given the above description of the principles of the invention. It is intended that all such modifications and variations be considered as within the spirit and scope of this invention, as it is defined in the following claims.

I claim:

1. A golf swing training device comprising:

a compact device having a housing and device attachment means affixed to a rear side of said housing, a belt member worn on the waist of a user and positioned adjacent one hip on a side of the user in a forward direction of the user's golf swing, said belt member having attachment means affixed to a front side of said belt member facing outwardly from the user's one hip and adapted to be fastened to the device attachment means so as to mount said device in a desired position on the one hip of the user;

an inertial mass acceleration sensor contained in said device housing for detecting when the user has moved the one hip with an acceleration exceeding a given threshold level upon execution of a golf swing, and a sound producing device coupled to said sensor for producing a sound output when the acceleration of the user's hip upon execution of the golf swing exceeds the given threshold level.

2. A golf swing training device according to claim 1, wherein said device housing is a cylindrical tube, said inertial mass acceleration sensor is comprised of a weighted ball held with a given level of retaining force by a retaining element at one end of said tube in the forward direction of the user's golf swing, and said sound producing element is a stop wall at an opposite end of said tube.

3. A golf swing training device according to claim 2, wherein said weighted ball is a metal ball, and said retaining element is a magnet.

4. A golf swing training device according to claim 3, further comprising a battery power source, and wherein said magnet is electrically actuated by said battery power source, and said sound producing element includes a switch which closes a sound producing circuit when impacted by the weighted ball.

5. A golf swing training device according to claim 3, wherein said metal ball has a weight of about 25 gms, and the retaining force of the magnet is about the force required to retain the metal ball until the tube is inclined at an angle of about 65 to 70 degrees to a horizontal position.

6. A golf swing training device according to claim 2, wherein as the user completes a hip turn with the golf swing and decelerates to a finish, the weighted ball travels back to the one end of the tube and strikes the retaining element so as to produces a second sound which indicates a completion of the golf swing.

7. A golf swing training device according to claim 1, wherein said device attachment means is composed of one type of fiber hook and loop fastening elements for fastening to a fastening zone on said belt member which is composed of a complementary type of fiber hook and loop fastener elements, allowing the device to be fastened at any desired position or angle thereon for varying the weight-shift force threshold of the inertial mass acceleration sensor.

8. A golf swing training device according to claim 1, wherein said inertial mass acceleration sensor is comprised of a weighted ball which is held in a plastic friction-fit cup arranged at one end of the device housing.

9. A golf swing training device according to claim 8, wherein said device housing is a transparent plastic tube having said cup arranged at one end, and said sound producing element is a plastic stop wall arranged at an opposite end of said tube.

10. A golf swing training device according to claim 8, wherein said cup has a hemi-spherical shape with an internal diameter slightly smaller than the weighted ball so that the ball is held firmly in the cup when pressed therein.

11. A golf swing training device according to claim 10, wherein said cup has slits formed in its hemi-spherical surface to provide flexibility for pressing said ball therein.

12. A golf swing training device according to claim 8, wherein said cup is mounted through a mounting wall by a spring-loaded stem for dissipating forces applied to said cup.

13. A golf swing training device according to claim 1, wherein said inertial mass acceleration sensor is an electronic motion sensor connected to an electronic circuit which sounds a tone through an output speaker when said sensor detects a weight-shift force exceeding the weight-shift force threshold.

14. A golf swing training device according to claim 13, wherein said motion sensor is a mercury switch.

15. A golf swing training device according to claim 13, wherein said motion sensor also detects the speed and timing of completion of motion, and produces a second output.

16. A golf swing training device according to claim 15, wherein said second output is a second sound.

17. A golf swing training device according to claim 15, further comprising an LCD display connected to said electronic circuit, wherein said second output is a display of a measured result of the motion speed or timing detected by said motion sensor on said LCD display.

18. A golf swing training device according to claim 13, further comprising a volume control connected to said electronic circuit for controlling the volume of the tone.

19. A method for training a golf swing with an inertial-mass sound-emitting device comprising the steps of:

providing a compact device having a housing and device attachment means affixed to a rear side of said housing;

attaching a belt member on the waist of a user and positioning the device via said device attachment means on said belt member at a desired position adjacent one hip on a side of the user in a forward direction of the user's golf swing, said belt member having attachment means affixed to a front side of said belt member facing outwardly from the user's one hip and adapted to be fastened to the device attachment means so as to mount said device in the desired position on the one hip of the user;

providing said device with an inertial mass acceleration sensor contained in the device housing for detecting when the user has moved the one hip with an acceleration exceeding a given threshold level upon execution of a golf swing, and a sound producing device coupled to said sensor for producing a sound output upon detection of such acceleration exceeding the given threshold level; and producing an audible sound with said device when the acceleration of the user's hip upon execution of the golf swing exceeds the given threshold level, so as to provide reinforcement to the user of a correct body movement in execution of the golf swing.

20. A method for training a golf swing according to claim 19, wherein said device attachment means is composed of one type of fiber hook and loop fastening elements, and said belt member has a fastening zone composed of a complementary type of fiber hook and loop fastener elements, and further comprising the step of positioning the device and fastening it at any desired position or angle on said fastening zone of said belt member.

* * * * *